United States Patent [19]

Craig

[11] 4,407,108

[45] Oct. 4, 1983

[54] APPARATUS AND METHOD FOR POWDER BAGGING

[75] Inventor: Stephen R. Craig, Wilmington, Del.

[73] Assignee: E. I. Du Pont de Nemours and Company, Wilmington, Del.

[21] Appl. No.: 220,852

[22] Filed: Dec. 29, 1980

[51] Int. Cl.[3] ..... B65B 9/12; B65B 57/14

[52] U.S. Cl. ..... 53/451; 53/502; 53/551; 177/25; 177/50; 141/83; 222/58

[58] Field of Search ..... 53/502, 551, 552, 473, 53/451; 177/25, 50; 141/94, 83; 222/58, 63, 77

[56] References Cited

U.S. PATENT DOCUMENTS

| | | | |
|---|---|---|---|
| 1,546,360 | 7/1925 | Bates . | |
| 2,050,314 | 8/1936 | Grunewald | 222/58 |
| 3,618,684 | 11/1971 | Burke et al. | 222/58 X |
| 3,682,339 | 8/1972 | Knappstein | 222/58 X |
| 3,707,172 | 12/1972 | Obara | 141/83 X |
| 4,018,029 | 4/1977 | Safranski et al. | 53/502 |
| 4,090,344 | 5/1978 | Kelly | 53/28 |
| 4,111,272 | 9/1978 | Ricciardi et al. | 177/50 |
| 4,117,647 | 10/1978 | Rossi | 53/502 |

*Primary Examiner*—Horace M. Culver

[57] ABSTRACT

Apparatus and method for automatically filling bags, which have been automatically formed on a vertical-form-fill-seal machine, with a predetermined weight of particulate material, said apparatus comprising a feeder means including a weighing means for measuring the loss in total weight of the feeder means and its contents.

8 Claims, 2 Drawing Figures

APPARATUS AND METHOD FOR POWDER BAGGING

DESCRIPTION

Technical Field

This invention relates to an apparatus and method for packaging an accurate predetermined weight of particulate material in a sealed bag. In particular, the present invention relates to a modified vertical-form-fill-seal (VFFS) packaging machine specially adapted to permit delivery of a precise predetermined weight of sticky, hard to handle particulate material into each of the bags formed thereon. For those materials, this operation is achieved faster and with greater accuracy than has heretofore been possible with conventional VFFS machines.

Background Art

One common type of packaging machinery for particulate materials is the vertical-form-fill-seal (VFFS) machine which forms a flat, continuous roll of packaging material into a tube, seals the bottom thereby forming a bag, dispenses product into the resulting bag, and seals the top. These machines have particular advantages when used with dusty or toxic products because the portion of the machine which dispenses product is enclosed by the packaging material from which the bag is formed. The principal drawback to the VFFS is the difficulty of proportioning sticky, hard to handle material into the bag with both accuracy and speed. One early example of such a machine is shown in U.S. Pat. No. 1,546,360, granted July 21, 1925 to Bates. While many improvements in materials and technique have matured over the years, the basic concept of a VFFS machine remains unchanged from that disclosed by Bates. A roll of packaging material is formed into a tube, the edges of the packaging material are fastened, the bottom of the tube of packaging material is closed to form a bag, particulate material is injected into the bag (conveniently via a funnel and auger arrangement), until the desired quantity is achieved, the top of the bag is sealed and cut from tube of packaging material following, the filled bag is removed from the apparatus and the process continues with the next bag. Bates controls the quantity of particulate material delivered to each bag by force feeding such material at a pre-set fast rate forcing the bag downward until the bottom of the bag trips a shut-off. The bag and contents then descend further onto a scale, and additional material is fed at slow rate until the desired weight is achieved.

The Bates machine and method are inherently slow and inaccurate by today's standards, and would not be suitable for use where the product is of high value per unit weight, of variable density or subject to compacting or sticking. Further, Bates machine and method would be quite slow, particularly if the initial fill failed to consistently deliver 98% of the final weight and large quantities of material must be fed at the slow rate.

Many improvements have been made since Bates. For example, many products are metered volumetrically, that is, a predetermined volume of product is conveyed into each package. This method is particularly suitable for granular or liquid materials which have a uniform and known density, but is not suitable for materials of variable density which are sold by weight. Net weight scale systems wherein the material is weighed into an interemediate receptacle prior to being dumped into a bag are sometimes used to assure weight accuracy. These systems, however, are unsuitable for powdery materials which would stay suspended in air when dumped or for sticky materials which stick to the container in which they are weighed.

A method frequently used for filling previously formed bags or containers involves placing the empty bag on a scale, measuring the weight as material is added to the bag, and stopping the dispenser when the necessary bag weight is reached. This method cannot be used with the conventional VFFS machine since the bag is formed as material is added and so cannot be fully supported on a scale.

Another embodiment is disclosed in U.S. Pat. No. 4,090,344, granted May 23, 1978 to Kelly, wherein a conventional VFFS machine is adapted with a scale and control means to measure the gain in weight of the bag during the final stages of the fill operation. More specifically, after the bag has been formed, a predetermined volume of particulate material is dispensed into the bag by rotation of the auger a predetermined number of times. At this point the auger slows to a dribble speed and a scale is activated to measure the weight of the bag and its contents. The scale readout is used to stop the auger and terminate the fill operation when the bag reaches the desired weight. It is necessary, however, to actually terminate the fill operation when the bag is less than the desired weight so that the material in flight from the dispenser to the bag brings the bag up to the desired weight. Inaccuracies occur in using this system to package sticky or variable density products, since the amount which will be "in flight" for any one bag is not known. Also inaccuracies occur from the variable effect of the film material connected between the weighing apparatus and the film supply.

DISCLOSURE OF THE INVENTION

While the machine and method disclosed by Kelly represents a vast improvement over the machine and method of Bates and many other commercially available VFFS machines, there are certain disadvantages inherent in the Kelly machine, which the present invention overcomes. The present invention utilizes a loss-in-weight concept, rather than gain-in-weight as in Kelly, which obviates the need for measuring the weight of the empty bag and, more importantly, isolates the scale system from the film supply weight effect and eliminates the need to guess or estimate the weight of particulate material "in flight" following shut off of the feed means. The novel method includes the steps of forming the bag as on a conventional VFFS system, weighing a hopper containing product to be packaged, monitoring the weight of the hopper as product is dispensed, and terminating the dispensing when the hopper weighs an amount less than its original weight equal to the desired weight of product per bag. Because the dispenser is enclosed in the VFFS machine, all the product which leaves the dispenser must necessarily land in the bag. Further, in operation of the Kelly machine, in order to get an accurate weight of the bag and its contents it is necessary to stop the VFFS machine and mechanically move the bagging material to develop a free loop in the film. Even then a small available additional amount of film is also being weighed.

BRIEF DESCRIPTION OF THE DRAWINGS

Referring to FIGS. 1 and 2, there is shown a vertical-form-fill-seal (VFFS) machine and feeder for carrying out the present invention. The VFFS machine, indicated generally at 1, includes a main housing 2 for enclosing and supporting major mechanical components, and auxiliary housing 3 which may contain electrical and control elements. Supported for free rotation on housing 2 is a roll 4 of flat sheet bagging material 5 which may be plastic film, plastic coated paper, etc.

Figure 1:
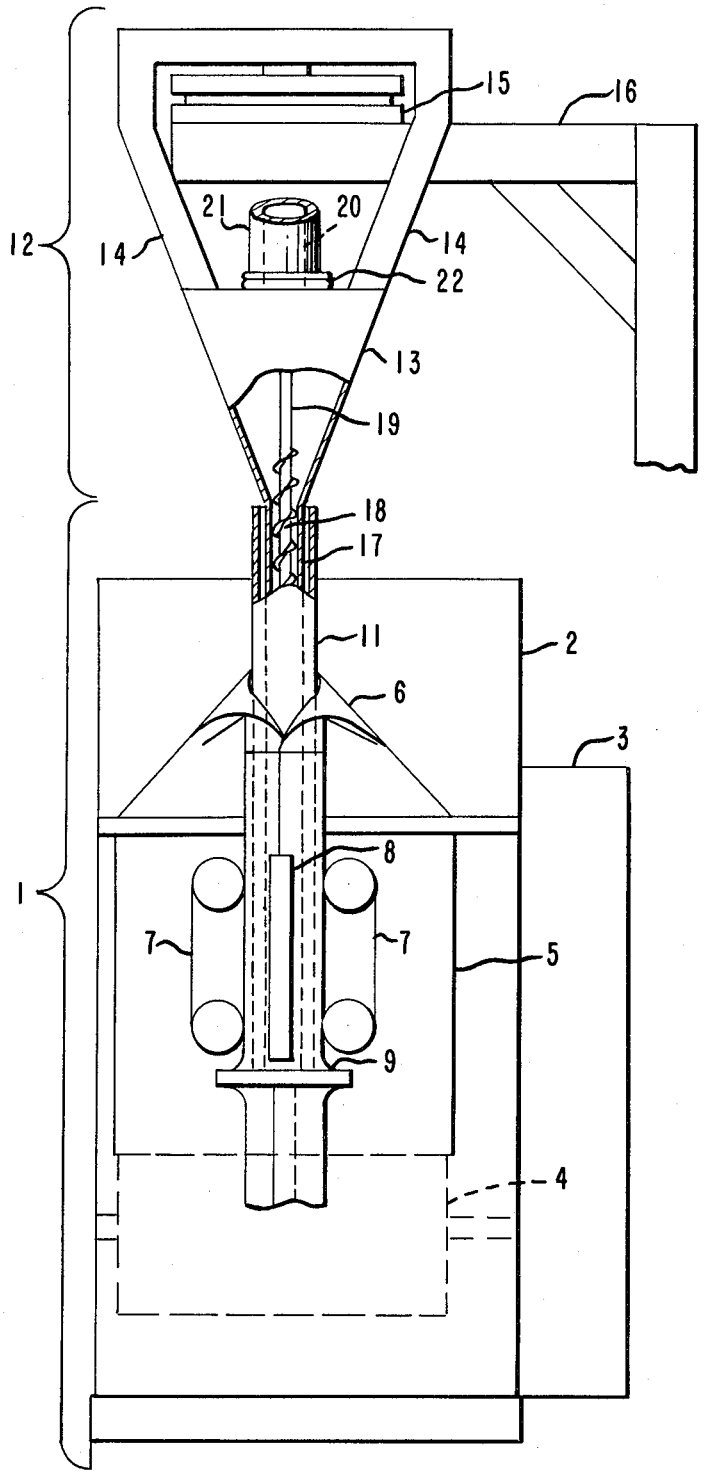
FIG. 1 is a front view partially in section of one embodiment of the apparatus of the present invention.

Secured to the front face of housing 2 are various components for forming tubular bags from the flat sheet bagging material, including forming collar 6, drive belts 7, vertical sealing bar 8, and horizontal sealing jaws 9. Cutter 10 is disposed within sealing jaws 9. Forming tube 11 extends through forming collar 6 and between drive belts 7, terminating above sealing jaws 9.

Disposed above VFFS machine 1 are the various components which comprise the loss-in-weight feeder 12. Hopper 13 is supported by means of support arms 14 on scale 15, which is, in turn, supported on external support beam 16. Hopper 13 terminates at its lower end in a cylindrical filler tube 17, positioned at least partially within forming tube 11 and concentric therewith. Feed auger 18 is suspended from the top of hopper 13 by means of shaft 19. Shaft 19 is connected to motor 20 which is, in turn, supported on the top of hopper 13. It should be noted that hopper 13, support arms 14, filler tube 17, auger 18, shaft 19 and motor 20 are completely supported on scale 15. Supply duct 21 connects hopper 13 with a source of product to be bagged (not shown). Bellows 22 isolates supply duct 21 from hopper 13 so that supply duct 21 does not affect the weight sensed by scale 15.

In operation, the bagging material 5 is unrolled from roll 4, fed around guide means within the VFFS machine, and passed over forming collar 6. From the forming collar, the bagging material is brought vertically downward surrounding forming tube 11 with a slight overlap. Drive belts 7 are pressed against forming tube 11 to frictionally engage the material surrounding it. Vertical sealing bar 8 provides heat and pressure against the overlapped material on forming tube 11 to heat seal the edges together thereby forming the packaging material into a tubular shape. Horizontal sealing jaws 9 provide heat and together with integral cutter 10 are closed over the bagging material, simultaneously heat sealing and cutting the bottom of the tube to form a bag, and simultaneously heat sealing and separating the top of the previous bag.

Filling of the bag proceeds in the following way: Particulate material to be bagged is introduced into hopper 13 through supply duct 21 between bag fills. Scale 15 is now actuated and measures the weight of hopper 13, support arms 14, filler tube 17, auger 18, shaft 19, motor 20, and roduct contained in the hopper 13. Motor 20 is energized, rotating auger 18 and conveying product into the bag while the scale continues to measure the weight of the hopper and associated components. As the product is being conveyed into the bag, drive belts 7 are actuated to draw the bag lower until the intended top of the bag is level with horizontal sealing bars 9. When the weight sensed differs from the weight initially sensed by an amount equal to the weight of the product desired to be placed in the bag, motor 20 is deactivated, terminating the flow of product. Sealing jaws 9 are closed, sealing the top of the bag, cutting the bag away from the machine, and sealing the bottom of the next bag.

This process continues with the filler metering out successive batches of product, each batch reducing the weight sensed by the scale by an amount equal to the desired bag weight, and depositing each batch into an automatically formed and sealed bag until the supply of product in hopper 13 is less than that required to fill a bag. At this time, hopper 13 is reloaded through supply duct 21 and a new cycle begins.

It can readily be seen from the foregoing that all of the particulate material that leaves filler tube 17 must necessarily enter the bag, particularly where, as in the preferred embodiment of the present invention, the filler tube 17 extends to the bottom of the forming tube. The critical measurement is loss in weight of the feeder 12, thus eliminating error or inaccuracy in measuring or estimating empty bag or the particulate material "in flight", and further eliminating the need for specially adapting the VFFS to create a free loop of packaging material for the final weight measurements. Accordingly the VFFS machine which forms an integral part of the present invention can be any commercially available VFFS machine, whereas the Kelly VFFS Machine must be specially adapted to accommodate the scales, load cells, free loop formation mechanism, etc.

Industrial Applicability

The apparatus and method of the present invention are useful for the accurate, fast and automatic packaging of a variety of particulate materials which may have high value per unit weight may be sticky or otherwise not free flowing, or may be subject to compacting or may otherwise be of variable density. They are particularly well suited where the particulate material may be toxic or otherwise dangerous or difficult to handle, e.g., certain agricultural pesticides.

Best Mode

Figure 2:
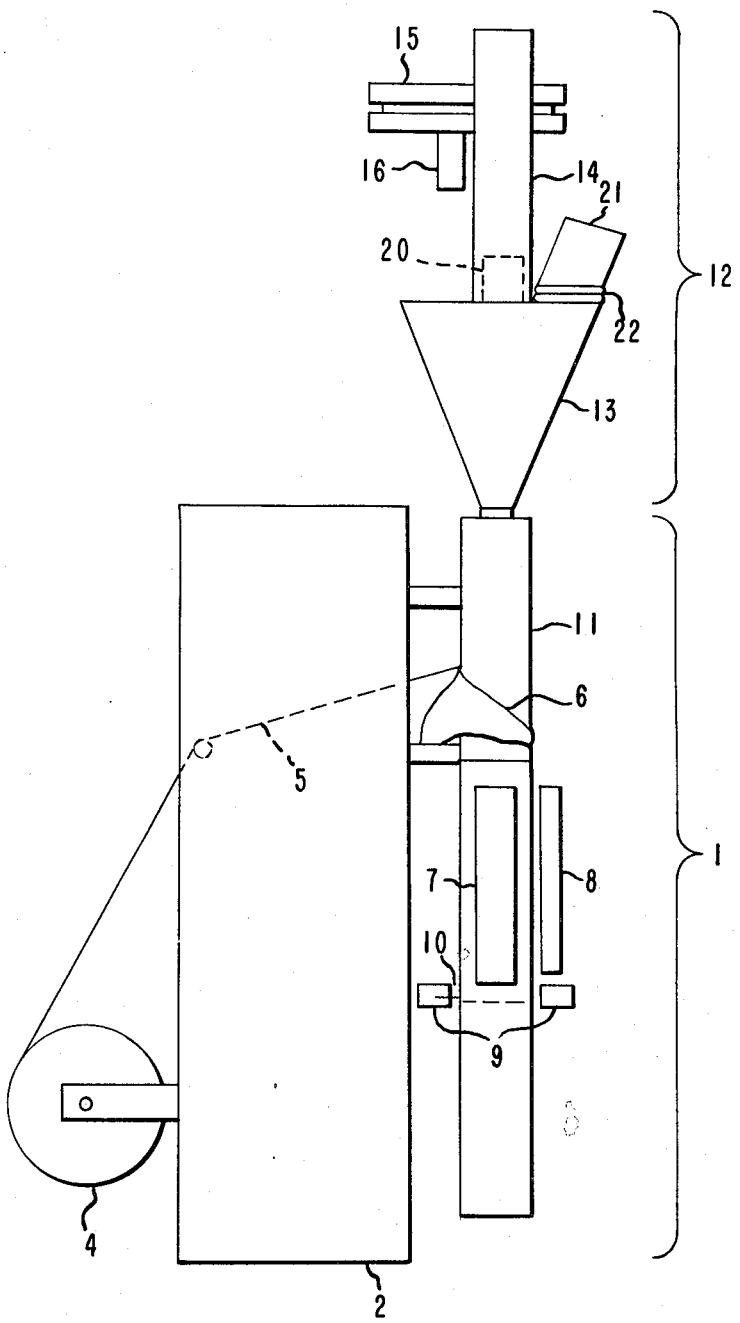
FIG. 2 is a side view of the same.

Although the best mode of the present invention may depend upon the particulate material being packaged, the packaging material being used, the quantity of particulate material to be packaged per bag and the number of bags to be packaged per unit time, generally the most preferred embodiment of the present invention is as shown in FIGS. 1 and 2 and described in detail above in this patent. Similarly, the most preferred method of operating the method of the present invention is as described in detail above in this patent. Further, the apparatus of the present invention is most conveniently and efficiently operated in combination with the control means disclosed in co-pending U.S. patent application No. 220,854 filed simultaneously herewith by Craig et al. and now U.S. Pat. No. 4,381,545.

The present invention having been described and exemplified above and in FIGS. 1 and 2, it should be understood that variations thereof can be made therefrom by those of ordinary skill in the art without departing from the teachings of the present application. Accordingly, reference should be made to the claims following, rather than to the foregoing specification, to determine the scope of the present invention.

I claim:

1. Apparatus for automatically filling bags, which have been automatically formed on a vertical-form-fill-seal machine, with a predetermined weight of particulate material comprising a feeder means for providing a supply of particulate material, dispensing a quantity of said particulate material, and measuring the weight of said particulate material dispensed, said feeder means comprising primary support means suitable for mounting on stationary structure or ground, weighing means mounted on said primary support means, secondary support means suspended from said weighing means, a hopper for holding a quantity of said particulate material which quantity is greater than said predetermined weight, said hopper mounted on said secondary support means, said hopper having means at or near the top for introducing said particulate material and having means at or near the bottom for dispensing said particulate material into an open bag which has been formed on a vertical-form-fill-seal machine, said weighing means being situated to measure the total weight of said secondary support means, said hopper and said particulate material in said hopper.

2. Apparatus of claim 1 further comprising a control means connected to said weighing means and said dispensing means, said control means comprising a means for sensing the weight measured by the weighing means and changes in said weight, and a means for activating and deactivating the dispensing means to deliver a predetermined weight of said particulate material to the bag.

3. Apparatus of claim 1 wherein said hopper is funnel shaped and terminates at its bottom in a filler tube.

4. Apparatus of claim 3 wherein said dispensing means comprises an auger positioned within said filler tube mounted on a shaft which, in turn, is connected to a motor attached to said hopper or to said secondary support means.

5. Apparatus of claim 4 wherein said auger extends to the bottom of said filler tube.

6. Apparatus of claim 5 wherein said filler tube is positioned within a forming means of a vertical-form-fill-seal machine.

7. Apparatus of claim 6 wherein said filler tube extends to the bottom of said forming means.

8. A method of automatically filling bags, which have been formed on a vertical-form-fill-seal machine, with a predetermined weight of particulate material comprising providing a quantity of said particulate material greater than said predetermined amount to a feeder means plus the particulate material contained therein, dispensing the particulate material from said feeder means into a bag formed on a vertical-form-fill-seal machine while monitoring the total weight of the feeding means plus particulate material contained therein, stopping the dispensing of the particulate material when the loss in total weight of the feeding means plus particulate material equals the predetermined weight.

* * * * *